United States Patent [19]

Saad

[11] Patent Number: 4,672,334

[45] Date of Patent: Jun. 9, 1987

[54] DUAL-BAND CIRCULAR POLARIZER

[75] Inventor: Saad M. Saad, Willowbrook, Ill.

[73] Assignee: Andrew Corporation, Orland Park, Ill.

[21] Appl. No.: 654,731

[22] Filed: Sep. 27, 1984

[51] Int. Cl.[4] ..... H01P 1/17

[52] U.S. Cl. ..... 333/21 A; 333/157

[58] Field of Search ..... 333/21 A, 21 R, 137, 333/136, 135, 157, 156, 251, 248; 343/756, 736

[56] References Cited

U.S. PATENT DOCUMENTS

| | | | |
|---|---|---|---|
| 2,557,882 | 6/1951 | Marie | 333/21 A X |
| 2,772,400 | 11/1956 | Simmons | 333/157 X |
| 3,755,760 | 8/1973 | Ohm | 333/157 |
| 4,100,514 | 7/1978 | DiTullio et al. | 333/21 A X |
| 4,305,051 | 12/1981 | Hai | 333/21 A |
| 4,353,041 | 10/1982 | Bryans et al. | 333/21 A |
| 4,394,048 | 8/1987 | Morz | 333/21 A X |

FOREIGN PATENT DOCUMENTS

| | | | |
|---|---|---|---|
| 0072552 | 6/1978 | Japan | 333/21 A |
| 0013752 | 2/1979 | Japan | 333/21 A |

OTHER PUBLICATIONS

F. Arndt et al., "Broadband Dual-Depth E-Plane Corrugated Square Waveguide Polariser", *Electronics Letters*, vol. 20, No. 11, May 24, 1984, pp. 458-459.

Jasik, *Antenna Engineering Handbook*, New York: McGrw-Hill, 1961, pp. 17-14-17-22.

T. A. Abele, "Inductive Post Arrays in Rectangular Waveguide", *Bell System Technical Journal*, vol. 57, Mar. 1978, pp. 577-594.

R. F. Harrington, *Time-Harmonic Electromagnetic Fields*, New York: McGraw-Hill, 1961, section 8.7.

Single-Band Circular Polarizer, Andrew Corporation Part No. 47545.

Dielectric-Loaded Polarizer, Andrew Corporation Part No. 75594.

Iris-Loaded Polarizer, Andrew Corporation Part No. 72523.

*Primary Examiner*—Eugene R. LaRoche
*Assistant Examiner*—Benny Lee
*Attorney, Agent, or Firm*—Stephen G. Rudisill

[57] ABSTRACT

A dual band circular polarizer for simultaneously transforming two to four linearly polarized waves of two different frequency bands into two to four circularly polarized waves, and vice versa, the polarizer comprising a waveguide of circular or square cross-sectional shape dimensioned to simultaneously propagate signals in two different frequency bands and two arrays of conductive elements, each array comprising a pair of diametrically opposed rows of conductive elements extending inwardly from the walls of the waveguide.

32 Claims, 10 Drawing Figures

DUAL-BAND CIRCULAR POLARIZER

TECHNICAL FIELD

The present invention relates generally to microwave polarizers, and, more particularly, to dual-band circular polarizers. Circular polarizers are devices that are capable of transforming linearly polarized waves into circularly polarized waves, and vice versa. The present invention is particularly concerned with circular polarizers which can simultaneously transform two to four linearly polarized waves of two different frequency bands into circularly polarized waves, and vice versa.

BACKGROUND ART

Various devices have been previously developed for transforming linearly polarized waves into circularly polarized waves. Examples include waveguides equipped with corrugations, screw arrays, dielectric sheets and irises, either individually or in combination. Few of these devices, however, are capable of simultaneously transforming waves of two different frequency bands, and those that do have this capability suffer from one or more shortcomings (e.g., high manufacturing costs, low power handling, and difficult and expensive tuning).

SUMMARY OF THE INVENTION

It is a primary object of the present invention to provide an improved circular polarizer that can simultaneously transform two to four linearly polarized waves of two different frequency bands into circularly polarized waves.

It is another object of this invention to provide such an improved circular polarizer which can be economically manufactured and yet provides excellent performance characteristics—i.e., low axial ratio and low VSWR—simultaneously over two frequency bands.

A further object of the present invention is to provide an improved circular polarizer which is capable of handling high power levels.

Yet another object of the present invention is to provide an improved circular polarizer which is easily adjustable for tuning, and which is, therefore, inexpensive to tune.

Other objects and advantages of the invention will be apparent from the following detailed description.

In accordance with the present invention, there is provided a dual band circular polarizer for simultaneously transforming two to four linearly polarized waves of two different frequency bands into two to four circularly polarized waves, the polarizer comprising a waveguide of circular or square cross-section and dimensioned to simultaneously propagate signals in two different frequency bands; and two arrays of conductive elements, each array comprising a pair of diametrically opposed rows of conductive elements extending inwardly from the walls of the waveguide for transforming the linearly polarized waves into elliptically polarized waves by creating a phase difference between the electrical field components parallel to the conductive elements and the electrical field components orthogonal thereto and perpendicular to the conductive elements, one of said arrays having a greater effect on the waves in one of said frequency bands, and the other of said arrays having a greater effect on the other of said frequency bands.

DESCRIPTION OF THE PREFERRED EMBODIMENTS

While the invention will be described in connection with certain preferred embodiments, it will be understood that it is not intended to limit the invention to these particular embodiments. On the contrary, it is intended to cover all alternatives modifications, and equivalents included within the spirit and scope of the invention as defined by the appended claims.

Figure 1:
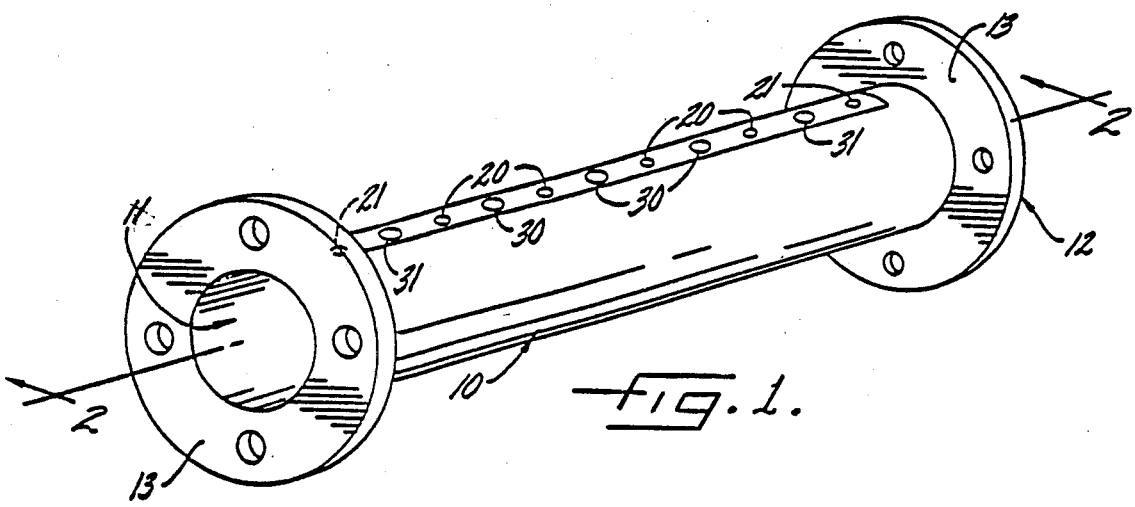
FIG. 1 is a perspective view of a dual-band circular polarizer embodying the present invention.
Figure 2:
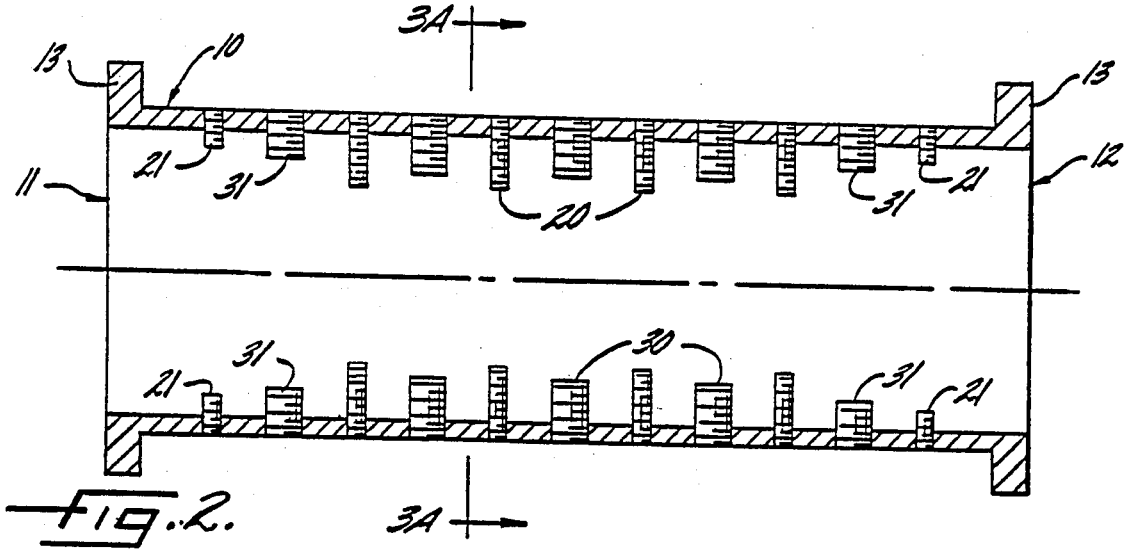
FIG. 2 is a section taken generally along line 2—2 in FIG. 1.

Turning now to the drawings and referring first to FIGS. 1 and 2, there is shown a dual band circular polarizer having a waveguide 10 with an open end or mouth 11 into which linearly polarized signals are introduced. The other end of the waveguide 10 is also open to form a mouth 12 through which the transformed signals are emitted. The illustrative waveguide 10 has a circular cross-sectional shape and is dimensioned so as to allow simultaneous propagation of linearly polarized signals of two different frequency bands. The waveguide has a flange 13 at both the inlet mouth 11 and the outlet mouth 12 thereby allowing interconnection of the polarizer to other waveguide sections.

In accordance with one important aspect of the present invention, the waveguide is equipped with two arrays of conductive elements, said elements having predetermined fixed diameters each array comprising a pair of diametrically opposed rows of conductive elements linearly disposed along the longitudinal length of the waveguide and extending radially inwardly from the walls of the waveguide for transforming the linearly polarized input waves into elliptically polarized waves by creating a phase difference between the electrical field components parallel to the conductive elements and the electrical field components orthogonal thereto which are perpendicular to both the conductive elements and the waveguide axis, one of the arrays having a greater effect on the waves in one of the frequency bands, and the other of the arrays having a greater effect on the other of the frequency bands. Thus, in the illustrative embodiment of the invention shown in FIG. 2, a first array of conductive elements comprises a pair of diametrically opposed rows of conductive elements 20 extending inwardly from the walls of the waveguide toward the central axis of the waveguide. A second array of conductive elements comprises another pair of diametrically opposed rows of conductive elements 30 extending inwardly from the walls of the waveguide toward the central axis of the waveguide, the conductive elements 30 differing from the conductive elements 20 in that they have different radial lengths and have, preferably, different diameters. In each of these arrays, the conductive elements 20, 30 take the form of screws so that they can be easily adjusted for tuning purposes. These conductive elements extend through the side of the waveguide 10, and can be moved in and out relative to the central axis, thereby allowing for easy adjustment of their radial length within the waveguide. Adjustment of the radial lengths of the conductive elements 20, 30 inside the waveguide tunes the polarizer, and thereby minimizes the ellipticity of the output waves. Once the polarizer is tuned so that the axial ratios (ellipticities) of the output waves are minimized, the portions of the conductive elements 20, 30 extending outside of the waveguide 10 are cut off and the conductive elements are permanently fixed into place in the waveguide (e.g., by soldering).

Figure 4:
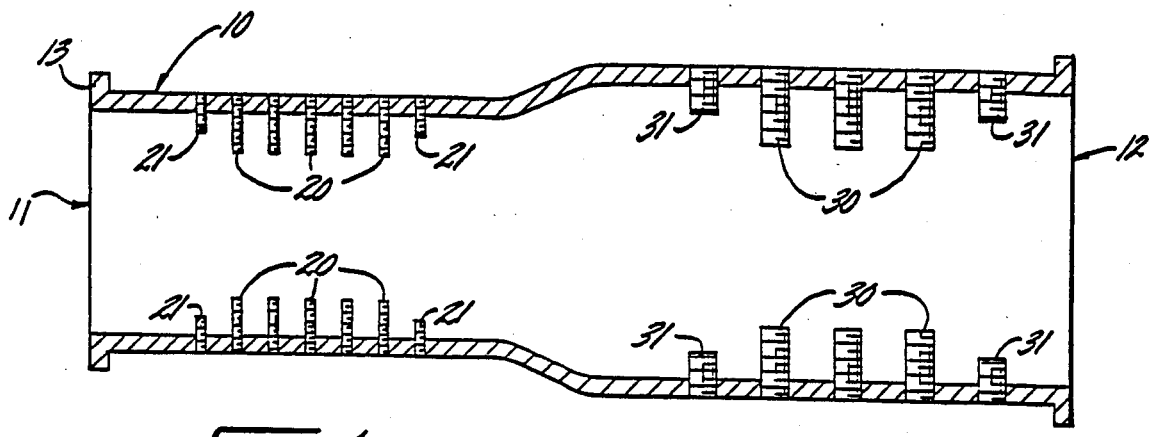
FIG. 4 is a section taken through the waveguide of a modified polarizer similar to that shown in FIG. 1 but having the conductive element arrays cascaded and having a tapered waveguide.
Figure 5A:
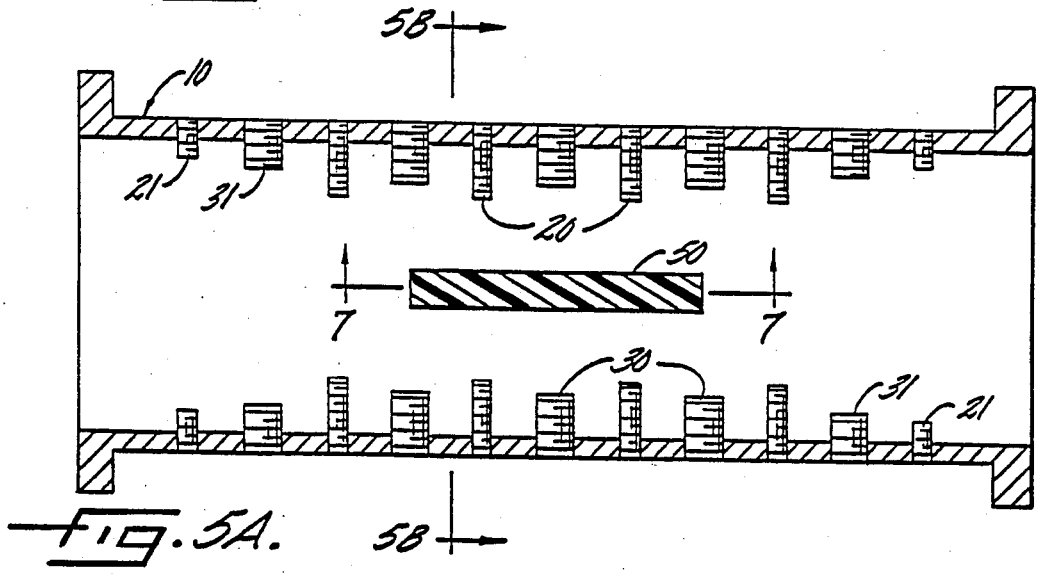
FIG. 5A is a section substantially similar to that shown in FIG. 2 but having a dielectric sheet overlapping the two conductive element arrays.
Figure 5B:
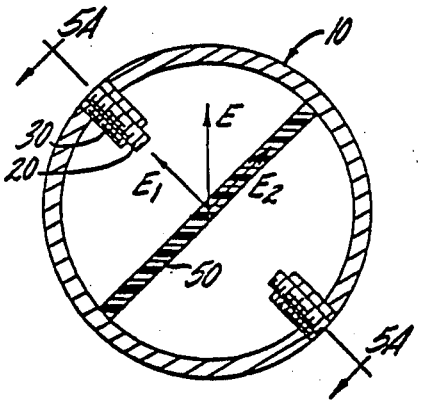
FIG. 5B is a section taken generally along the line 5B—5B in FIG. 5A.

The two arrays of conductive elements 20, 30 can be either interlaced (i.e., placed in the same section of the waveguide) or cascaded (i.e., placed in different sections of the waveguide). When the two arrays are interlaced (see FIG. 2), the conductive elements are arranged so that as the microwave signal passes through the polarizer, it alternately encounters a diametrically opposed pair of conductive elements 20 of the first array and then a diametrically opposed pair of conductive elements 30 of fthe second array, and so on. On the other hand, when the two arrays are cascaded (see FIG. 4), a microwave signal passing through the polarizer first encounters the entire array of first conductive elements 20 and then encounters the entire second array of conductive elements 30. Furthermore, as shown in FIG. 4, if the two arrays are cascaded, there is an option of having the two arrays located in sections of the waveguide having different diameters. This is accomplished by tapering the waveguide 10 between the first array of conductive elements 20 and the second array of conductive elements 30. This extra design parameter, when optimized, theoretically enables the polarizer to yield better performance. This configuration results in an overall increase in the polarizer length, however, making it somewhat undesirable for some uses.

Figure 3A:
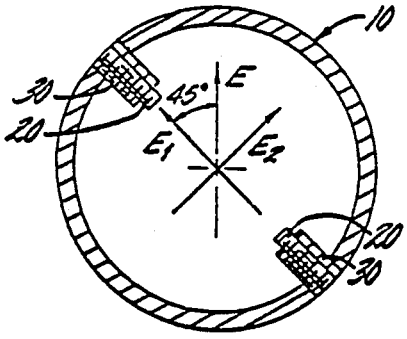
FIG. 3A is a section taken generally along line 3A—3A in FIG. 2.

The two arrays of conductive elements 20, 30 can also be arranged either colinearly or orthogonally. In the colinear arrangement, as illustrated in FIG. 3A, the conductive elements of both array lie in the same plane. On the other hand, in the orthogonal arrangement, as illustrated in FIG. 3B, the conductive elements 20 of the first array lie in a plane which is orthogonal to the plane in which the conductive elements 30 of the second array lie.

A linearly polarized wave (i.e., a wave in which the electric field vector maps out, during the passahge of a full cycle, an ellipse having a minor-to-major axis ratio of zero) is changed into a circularly polarized wave by having a phase difference of 90° created between the orthogonal components of this electric field vector. This phase change is caused by the capacitive nature of the conductive elements 20, 30 in the two arrays. Referring to the colinear arrangement of FIG. 3A, the input wave is aligned such that its electric field vector E forms an angle of 45° with the plane in which the two arrays of conductive elements lie. Accordingly, the orthogonal components of this electrical field vector $E_1$, $E_2$ are aligned such that $E_1$ is parallel to the plane in which the conductive elements of the arrays lie, while $E_2$ is perpendicular to that plane. Component $E_1$ is slowed down as it passes by the arrays of conductive elements, while $E_2$ barely "sees" the conductive elements, and passes virtually unhindered. Therefore, if the conductive elements are properly adjusted (tuned), a phase shift of 90° is created between $E_1$ and $E_2$, thereby transforming the linearly polarized wave into a circularly polarized wave.

It should be noted that in a colinear arrangement of the conductive element arrays, as shown in FIG. 3A, the two arrays act in unison on the electric field components $E_1$ of both linearly polarized input waves (i.e., both frequency bands) to create 90° phase shifts in, and to thereby circularly polarize, both of these waves. If one of the arrays were removed, neither of the linearly polarized input waves would be transformed into a circularly polarized wave. Rather, both of the input waves would energe in elliptically (i.e., imperfectly circular) polarized form. This is because each of the conductive element arrays creates part of the 90° phase shift necessary to transform each of the linearly polarized input waves. Only by having both of the arrays present will either of the linearly polarized input waves be transformed into a circularly polarized wave.

Figure 3B:
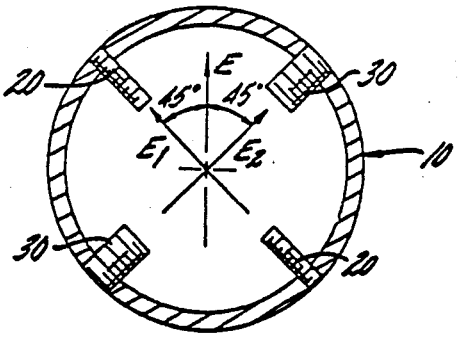
FIG. 3B is a section taken through the waveguide of a modified polarizer similar to that shown in FIG. 2 but having the conductive element arrays arranged orthogonally.

Considering now FIG. 3B, wherein the two arrays of conductive elements are arranged orthogonally, the linearly polarized input wave is aligned such that its electric field vector E forms a 45° angle with each of the planes of the first and second conductive element arrays. In this configuration, component $E_1$ of the electric field vector is slowed down by the conductive elements 20 of the first array, while at the same time it passes by the conductive elements 30 of the second array virtually unhindered. On the other hand, component $E_2$ of the electric field vector is slowed down by the conductive elements 30 of the second array, but passes by the conductive elements 20 of the first array virtually unhindered. When the effects of $E_1$ and $E_2$ are combined, a 90° phase shift is realized and, therefore, the linearly polarized input waves are transformed into circularly polarized waves.

In designing the two arrays of conductive elements, it is desired that the dual band circular polarizer exhibit a low axial ratio (i.e., a near-unitary minor-to-major axis ratio of the ellipse mapped out by the electric vector of the resultant circularly polarized wave during the passage of a full cycle) and a minimal VSWR (i.e., a low ratio between the sum and difference of the incident and reflected voltage waves). In the particular embodiments illustrated, there are four main tuning parameters pertaining to each array which affect these two design objectives, including the radial length, the diameter, the number, and the longitudinal spacing of the conductive elements. A tuning parameter of equal importance, but pertaining to the combination of the two arrays, is the ratio of each of these four parameters in one array to its counterpart in the other array. Furthermore, when the two arrays are cascaded and the waveguide is tapered as illustrated in FIG. 4, it must be taken into account that the tapering of the waveguide (i.e., changing its diameter) changes the guide wavelength at midband ($\lambda_g$), which in turn alters the effects of adjusting the other tuning parameters.

As a general rule, more phase delay is created if the radial length, the diameter, and/or the spacing between the elements is increased. In other words, adjustment of these parameters affects the axial ratio of the resultant output waves. Typically, the spacing between the screws of each array should be much smaller than the guide wavelength at the midband frequency of the upper band (i.e., 0.1 to 0.25 $\lambda_g$). Spacing is not a critical design factor as long as it falls within these guidelines, and is uniform throughout the array. Furthermore, the diameter of the conductive elements is not a critical design factor because of the adjustability of the radial lengths of the conductive elements. Consequently, the two most useful tuning parameters are the number of conductive elements and the radial lengths of the conductive elements in each array. It should be noted that, as with spacing, the radial lengths of the conductive elements is uniform throughout each array.

In order to achieve a low VSWR, the conductive elements 21 at the ends of the first array and the conductive elements 31 at the ends of the second array have radial lengths different from the other elements 20, 30 in their respective arrays. These end elements are used for impedance matching, and thereby lower the VSWR. Nevertheless, they also affect the axial ratio of the output signals. Consequently, their radial lengths must be adjusted at the same time adjustments are made on the other conductive elements 20, 30 in the arrays.

The dual-band circular polarizer of this invention produces excellent performance characteristics when used in conjunction with microwave signals in the four and six gigahertz (GHz) frequency bands, i.e., in the frequency bands of 3.7–4.2 GHz and 5.925–6.425 GHz. In particular, this polarizer is effective in simultaneously transforming two to four linearly polarized signals, one or two in the 4-GHz frequency band and the other one or two in the 6-GHz frequency band, into two to four circularly polarized waves, and it exhibits low axial ratio and low VSWR.

One specific example of such a dual-band circular polarizer was made with a waveguide of circular cross section, 22 inches long, and a 2.125 inch inside diameter. The first array of conductive elements consisted of 29 pairs of screws, size 4–40 (major diameter of 0.11 inches), and each having a radial length of 0.11 inches from the inside surface of the waveguide. The second array of conductive elements was colinearly interlaced with the first array, as shown in FIG. 2. This second array consisted of 28 pairs of screws, size 8–32 (major diameter of 0.16 inches), and each having a radial length of 0.08 inches. The center-to-center spacing between each conductive element 20 in the first array and the adjoining conductive element 30 in the second array was 0.36 inches. It will be noted that this spacing falls within the design parameters discussed before. The midband guide wavelength ($\lambda_g$) of waves in the 6-GHz band is 2.25 inches, and thus proper spacing is between 0.225 inches and 0.562 inches. Consequently, since the spacing used in the above-mentioned design is 0.36 inches, the design criteria for transforming both 4-GHz and 6-GHz waves are met.

In a test for linearly polarized input waves, two in the 4-GHz band and the other two in the 6-GHz band, this polarizer produced the following results:

| Frequency Band (GHz) | 3.7–4.2 | 5.925–6.425 |
|---|---|---|
| Axial Ratio (dB) | 1.3 | 0.75 |
| Return Loss (dB) | −28 | −31 |

Figure 6B:
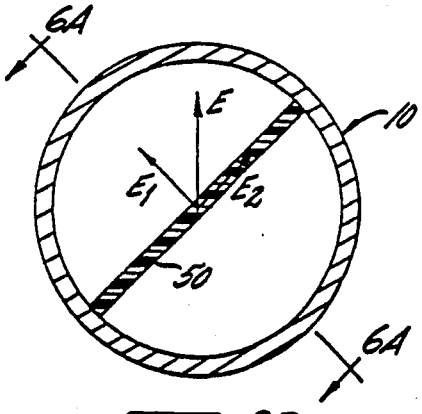
FIG. 6B is a section taken generally along the line 6B—6B in FIG. 6A.
Figure 6A:
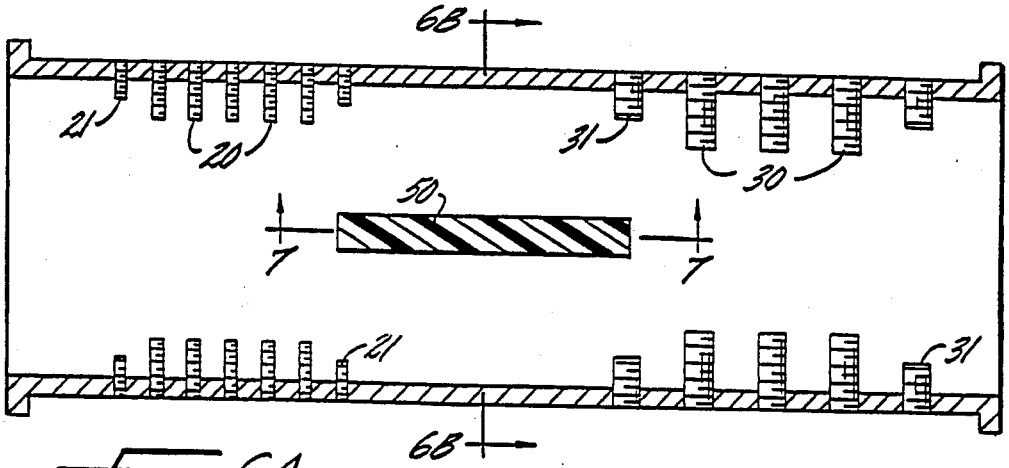
FIG. 6A is a section substantially similar to that shown in FIG. 4 but having a dielectric sheet cascaded with the two conductive element arrays.
Figure 7:
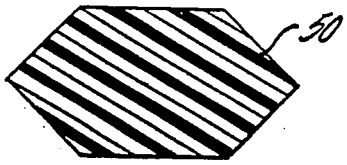
FIG. 7 is a side elevational view of the dielectric sheet taken generally along the line 7—7 in FIGS. 5A and 6A.

A possible variation on this circular polarizer involves the use of a dielectric sheet as illustrated in FIGS. 5A, 5B, 6A, 6B and 7. This dielectric sheet 50 (FIG. 7) can be arranged to overlap the two conductive element arrays when they are interlaced (FIGS. 5A and 5B), or can be cascaded with the two conductive element arrays when they are cascaded (FIGS. 6A and 6B). In each configuration, the dielectric sheet 50 is positioned so that it forms a 45° angle with the electric field vector E of the linearly polarized input waves and, therefore, contributes to the phase shift between the orthogonal electric field vector components $E_1$ and $E_2$. The use of the dielectric sheet 50 in combination with the conductive elements 20, 30 may permit the attainment of more perfect circular polarization (i.e., a lower axial ratio) in certain applications.

Although not illustrated, the waveguide 10 can also be modified to have different cross-sectional configurations, including square and quadruply ridged square. Furthermore, the conductive elements 20, 30 can take the form of vanes or fins, rather than screws.

As can be seen from the foregoing detailed description, this invention provides an improved dual-band circular polarizer that can be economically manufactured and yet provides excellent performance characteristics. It can simultaneously transform four waves from two different frequency bands from a linear polarization to a circular polarization. Furthermore, it offers low axial ratio and low VSWR. This polarizer also is easily tunable and, therefore, is inexpensive to tune.

What is claimed is:

1. A dual band circular polarizer for simultaneously transforming two to four linearly polarized input waves of different frequency bands, each having the same plane of polarization, into two to four circularly polarized output waves and vice versa, comprising:

a waveguide section dimensioned to support the propagation of said waves of different frequencies; and two arrays of conductive elements, said elements of each array having respective predtermined fixed cross-sectional dimensions, each array comprising a pair of diametrically opposed rows of conductive elements linearly disposed along the longitudinal length of the waveguide and extending radially inwardly from the walls of the waveguide for transforming the linearly polarized input waves of both frequency bands into circularly polarized waves by creating a phase difference between the electric field components parallel to the conductive elements and the electric field components orthogonal thereto which are perpendicular to both the conductive elements and the waveguide axis, one of said arrays having a greater effect on the waves in one of said frequency bands, and the other of said arrays having a greater effect on the other of said frequency bands.

2. The dual band circular polarizer of claim 1 wherein the conductive elements of both the first and second arrays are adjustable in radial length so that the polarizer can be tuned for achieving substantial circularity of polarization in each of the two to four output waves.

3. The dual band circular polarizer of claim 1 wherein the conductive elements of the first array have a first fixed uniform radial length, and the conductive elements of the second array have a second fixed uniform radial length different from that of the conductive elements in the first array.

4. The dual band circular polarizer of claim 1 wherein the conductive elements of the first array have first fixed uniform cross-sectional dimensions, and the conductive elements of the second array have second fixed uniform cross-sectional dimensions different from those of the conductive elements in the first array.

5. The dual band circular polarizer of claim 1 wherein the axis-to-axis spacing between adjacent conductive elements in each of the two arrays, respectively, is uniform and equal.

6. The dual band circular polarizer of claim 1 wherein the first and second arrays of conductive elements are colinear and interlaced with one another.

7. The dual band circular polarizer of claim 1 wherein the first and second arrays of conductive elements are orthogonal and interlaced with one another.

8. The dual band circular polarizer of claim 1 wherein the first and second arrays of conductive elements are colinear and cascaded with one another.

9. The dual band circular polarizer of claim 1 wherein the first and second arrays of conductive elements are orthogonal and cascaded with one another.

10. The dual band circular polarizer as described in claims 8 or 9, wherein the waveguide is tapered so that the first array of conductive elements lies in a first waveguide section having one diameter while the second array of conductive elements lies in a second waveguide section having a different diameter.

11. The dual band circular polarizer of claim 1 wherein a dielectric sheet is arranged within the waveguide at 45 degrees to the plane of polarization of the linearly polarized input waves.

12. A dual band circular polarizer for simultaneously transforming two to four linearly polarized input waves of different frequency bands, each having the same plane of polarization, into two to four circularly polarized output waves, and vice versa, comprising:

a waveguide section dimensioned to support the propagation of said waves of different frequencies; and two arrays of conductive elements, said elements of each array having respective predetermined fixed cross-sectional dimensions, each array comprising a pair of diametrically opposed rows of conductive elements linearly disposed along the longitudinal length of the waveguide and extending radially inwardly from the walls of the waveguide for transforming the linearly polarized input waves of both frequency bands into circularly polarized waves by creating a phase difference between the electric field components parallel to the conductive elements and the electric field components orthogonal thereto which are perpendicular to both the conductive elements and the waveguide axis, the conductive elements in one of said arrays having a uniform radial length greater than the uniform radial length of the conductive elements in the other of said arrays.

13. The dual band circular polarizer of claim 12 wherein the conductive elements of both the first and second arrays are adjustable in radial length so that the polarizer can be tuned for achieving substantial circularity of polarization in each of the two to four output waves.

14. The dual band circular polarizer of claim 12 wherein the conductive elements of the first array have a first fixed uniform radial length, and the conductive elements of the second array have a second fixed uniform radial length.

15. The dual band circular polarizer of claim 12 wherein the conductive elements of the first array have first fixed uniform cross-sectional dimensions, and the condutive elements of the second array have second fixed cross-sectional dimensions different from those of the conductive elements in the first array.

16. The dual band circular polarizer of claim 12 wherein the axis-to-axis spacing between adjacent conductive elements in each of the two arrays, respectively, is uniform and equal.

17. The dual band circular polarizer of claim 12 wherein the first and second arrays of conductive elements are colinear and interlaced with one another.

18. The dual band circular polarizer of claim 12 wherein the first and second arrays of conductive elements are orthogonal and interlaced with one another.

19. The dual band circular polarizer of claim 12 wherein the first and second arrays of conductive elements are colinear and cascaded with one another.

20. The dual band circular polarizer of claim 12 wherein the first and second arrays of conductive elements are orthogonal and cascaded with one another.

21. The dual band circular polarizer as described in claims 19 or 20, wherein the waveguide is tapered so that the first array of conductive elements lies in a first waveguide section having one diameter while the second array of conductive elements lies in a second waveguide section having a different diameter.

22. The dual band circular polarizer of claim 12 wherein a dielectric sheet for providing supplemental phase shifting is arranged within the waveguide at 45 degrees to the plane of polarization of the linearly polarized input waves.

23. A method of simultaneously transforming two to four linearly polarized input waves of different frequency bands, each having the same plane of polarization, into two to four circularly polarized output waves and vice versa, which comprises:

providing a waveguide of section dimensioned to support the propagation of said waves of different frequencies;

equipping the waveguide with two arrays of conductive elements, each array comprising a pair of diametrically opposed linear rows of conductive elements having respective uniform radial lengths extending radially inwardly from the walls of the waveguide;

introducing the two to four linearly polarized input waves into the waveguide such that the plane of polarization of each of these waves lies on 45 degree angles with the planes in which are arranged the conductive elements of the first and second arrays of conductive elements.

24. The method of claim 23, further comprising: tuning the waveguide for achieving substantial circularity of polarization in each of the two to four output waves by adjusting the radial lengths of the conductive elements of both the first and second arrays.

25. The method of claim 24, further comprising: adjusting the uniform radial lengths of the conductive elements in both the first and second arrays so that the uniform radial lengths of the elements in the first array differ from the uniform radial lengths of the conductive elements in the second array.

26. The method of claim 23, further comprising: arranging the conductive elements of the two elements such that the axis-to-axis spacing between adjacent elements in each of the two arrays, respectively, is uniform and equal.

27. The method of claim 23, further comprising: arranging the first and second arrays of conductive elements so that they are colinear and interlaced with one another.

28. The method of claim 23, further comprising: arranging the first and second arrays of conductive elements so that they are orthogonal and interlaced with one another.

29. The method of claim 23, further comprising: arranging the first and second arrays of conductive elements so that they are colinear and cascaded with one another.

30. The method of claim 23, further comprising: arranging the first and second arrays of conductive elements so that they are orthogonal and cascaded with one another.

31. The method as described in claims 29 or 30, further comprising: tapering the waveguide so that the first array of conductive elements lies in a first waveguide section having one diameter while the second array of conductive elements lies in a second waveguide section having a different diameter.

32. The method of claim 23, further comprising: arranging a dielectric sheet within the waveguide at 45 degrees to the plane of polarization of the linearly polarized input waves.

* * * * *